US008035248B2

(12) United States Patent
Duarte et al.

(10) Patent No.: US 8,035,248 B2
(45) Date of Patent: Oct. 11, 2011

(54) SYSTEMS AND PROCESS FOR ENERGIZING LOADS THROUGH A CONTROL UNIT

(75) Inventors: Ronaldo Riberio Duarte, Joinville-SC (BR); Marcos Guilherme Schwarz, Joinville-SC (BR)

(73) Assignee: Whirlpool S.A., Sao Paulo-Sp (BR)

( * ) Notice: Subject to any disclaimer, the term of this patent is extended or adjusted under 35 U.S.C. 154(b) by 0 days.

(21) Appl. No.: 11/568,682

(22) PCT Filed: May 5, 2005

(86) PCT No.: PCT/BR2005/000072

§ 371 (c)(1),
(2), (4) Date: Jan. 24, 2007

(87) PCT Pub. No.: WO2005/106359

PCT Pub. Date: Nov. 10, 2005

(65) Prior Publication Data

US 2007/0185589 A1 Aug. 9, 2007

(30) Foreign Application Priority Data

May 5, 2004 (BR) ..... 0402015

(51) Int. Cl.
*H02J 3/00* (2006.01)

(52) U.S. Cl. ..... 307/11; 307/36; 307/116; 307/125

(58) Field of Classification Search ..... 307/11, 307/36, 116, 125
See application file for complete search history.

(56) References Cited

U.S. PATENT DOCUMENTS

| | | | | |
|---|---|---|---|---|
| 4,843,833 | A * | 7/1989 | Polkinghorne | 62/180 |
| 5,477,699 | A * | 12/1995 | Guess et al. | 62/187 |
| 5,479,785 | A * | 1/1996 | Novak | 62/155 |
| 5,711,159 | A * | 1/1998 | Whipple, III | 62/82 |
| 6,014,325 | A * | 1/2000 | Pecore | 363/126 |
| 6,097,761 | A * | 8/2000 | Buhring et al. | 375/257 |
| 6,147,967 | A * | 11/2000 | Ying et al. | 370/222 |
| 6,473,469 | B1 * | 10/2002 | Leitch | 375/308 |
| 6,590,755 | B1 * | 7/2003 | Behr et al. | 361/62 |
| 6,655,158 | B1 * | 12/2003 | Wiseman et al. | 62/73 |

(Continued)

FOREIGN PATENT DOCUMENTS

EP 0 711 018 5/1996

*Primary Examiner* — Jared Fureman
*Assistant Examiner* — Adi Amrany
(74) *Attorney, Agent, or Firm* — Gifford, Krass, Sprinkle, Anderson & Citkowski, P.C.

(57) ABSTRACT

A system and a process for energizing loads through a control unit, said loads being energized from a power network, said system comprising: connecting elements, each including a processing unit operatively connected to a respective power switch so as to lead the latter to opening and closing conditions, de-energizing and energizing a respective adjacent load that is electrically coupled to the connecting element; a pair of electrical conductors connected to a power network for energizing the loads and which are disposed so as to define an energizing means which is common to the connecting elements and to the control unit; and a signal conductor not galvanically isolated from the power network and which is common to the processing units and to the control unit, connecting them so as to allow the control unit to instruct, through the processing units and through coded electrical signals, the opening and closing of each respective power switch.

7 Claims, 4 Drawing Sheets

U.S. PATENT DOCUMENTS 6,711,613 B1 * 3/2004 Ewing et al. ..... 709/223
6,880,949 B2 * 4/2005 Miozza et al. ..... 362/92
6,956,461 B2 * 10/2005 Yoon et al. ..... 340/310.11
7,043,647 B2 * 5/2006 Hansen et al. ..... 713/320
7,109,604 B2 * 9/2006 Kablaoui et al. ..... 307/31
7,162,521 B2 * 1/2007 Ewing et al. ..... 709/223
7,774,443 B2 * 8/2010 Ewing et al. ..... 709/223
2004/0112072 A1 6/2004 Collins
2005/0219827 A1 * 10/2005 Tateyama et al. ..... 361/736

* cited by examiner

SYSTEMS AND PROCESS FOR ENERGIZING LOADS THROUGH A CONTROL UNIT

RELATED APPLICATIONS

This is a U.S. National Phase Application under 35 U.S.C. §371 of International Patent Application Number PCT/BR2005/000072 filed May 5, 2005, which claims priority to Brazilian Patent Application Number PI 0402015-4 filed May 5, 2004, both of which are hereby incorporated by reference. The International Application published in English on Nov. 10, 2005 as WO-2005/106359 A1 under PCT Article 21(2).

FIELD OF THE INVENTION

The present invention refers to a system and a process to enable the energization and the bidirectional serial communication for controlling the loads provided in electrical household appliances, such as refrigerators, freezers, laundry machines, etc., through a control unit.

BACKGROUND OF THE ART

Most electrical household appliances have a large number of electrical loads distributed throughout the system, such as for example lamps, fans, valves, motors, etc., which are essential to the operation of the equipment and typically commanded by a control unit, which supplies or not voltage thereto as a function of the process requirements. The energization control of the loads is effected by semi-conducting electromechanical or triac AC switches, such as the electromagnetic relays, which are typically located in a power unit that receives the voltage from the power network and distributes it to the loads through adequate electrical cables. FIG. 1 shows a typical diagram of the electrical connections of a refrigerator 1 operatively connected to a power network 2 and comprises a control unit 3, a power unit 4, a fan 5, a defrost resistance 6, an internal lamp 7 and a compressor 8. As it can be noted, the existence of several loads in the system requires a large number of cables 9 distributed throughout the appliance, increasing the electromagnetic noise, the cost of the wirings and making difficult the mounting process, bearing in mind that the larger the number of loads and wirings the higher the complexity of the system.

In order to reduce the aforesaid problems related to the distribution of loads, the automobile industries have developed serial communication standards, aiming at eliminating the individual cables for each load of the system. Among said standards, CAN standard is the best known. For applications in which the system does not require high speed or high data flow, the so-called LIN standard has been developed. In said applications, the voltage is directly supplied to the load, which has a local power switch and the control unit 2 commands the selective energization of the load through serial communication. In both serial communication standards, the level of the signal used in the communication is different from the level of the voltage of the AC power network. Thus, for applications in household appliances, special circuits for conversion of signals should be used, as well as the installation of two additional conductors exclusively for the serial communication.

A serial communication standard known as X-10 specifies the serial communication directly through the power network by modulating a high frequency signal over the network, which signal is normally used for establishing communication between appliances in a home or to access the Internet, dispensing the installation of telephone or network cables.

The great disadvantage of said standard is that it requires a usually complex and relatively expensive filtering circuit for separating the communication signal from the power network.

There is also the industrial communication standard known as AS-i, whose principle is similar to that of the already described X-10, in which supply voltage and communication travel through the same conductors, in different frequency spectra, in which case the supply voltage is in DC, usually of 24 Vdc. AS-i standard is widely used in industrial networks for communication with sensors and actuators.

It can be concluded from the basic description of some of the existing communication standards that all of them require complex dedicated electronic circuits to execute the tasks of separating and/or treating the signals, but which become infeasible in systems in which cost is a preponderant factor and which do not require high speed or transmitted data high flow.

OBJECTS OF THE INVENTION

Thus, it is an object of the present invention to provide a system for energizing loads through a control unit, for loads provided in electrical household appliances, from a serial communication network, with a simple and strong topology and of reduced cost and which allows reducing the manufacture and assembly costs of said appliances, simplifying the assembly and reducing the steps involved in the manufacture of said electrical appliances and which can be used in large scale in said appliances.

It is a further object of the present invention to provide a system as cited above, which allows the modularity and expansion of said system.

It is a further object of the present invention to provide a system as cited above, which can dispense the use of specific boxes and power units for each project.

It is a further object of the present invention to provide a process for energizing loads through a control unit, said loads being located in an electrical appliance, which can simplify the assembly of the presently used systems.

It is a further object of the present invention to provide a process as cited above, which can be implemented with micro-controllers of low cost.

SUMMARY OF THE INVENTION

These and other objects of the present invention are attained by a system for energizing loads through a control unit, said loads being energized from a power network, said system comprising: connecting elements, each comprising a power switch and a processing unit operatively connected to the power switch so as to lead the latter to opening and closing conditions, de-energizing and energizing a respective adjacent load that is electrically coupled to the connecting element; a pair of electrical conductors connected to the power network and which are disposed so as to define an energizing means which is common to the connecting elements and to the control unit; and a signal conductor, not galvanically isolated from the power network and which is common to the processing units and to the control unit, connecting them so as to allow the control unit to instruct, through the processing units and through coded electrical signals, the opening and closing of each respective power switch.

The system for energizing said loads operates, according to the present invention, through a process including the steps of: a—connecting the power network to the control unit by means of a pair of electrical conductors; b—connecting, electrically and through a respective power switch, each load to said pair of electrical conductors; c—operatively associating, to each power switch, a respective processing unit which is designed to lead said respective power switch to opening and closing conditions; d—connecting the control unit to the processing units through only one signal conductor, not galvanically isolated from the power network and which is common to said units, in order to instruct through said processing units the opening and closing conditions of the respective power switches.

BRIEF DESCRIPTION OF THE DRAWINGS

The invention will be described below with reference to the enclosed drawings, given by way of example only and in which.

DETAILED DESCRIPTION OF THE INVENTION

Figure 1:
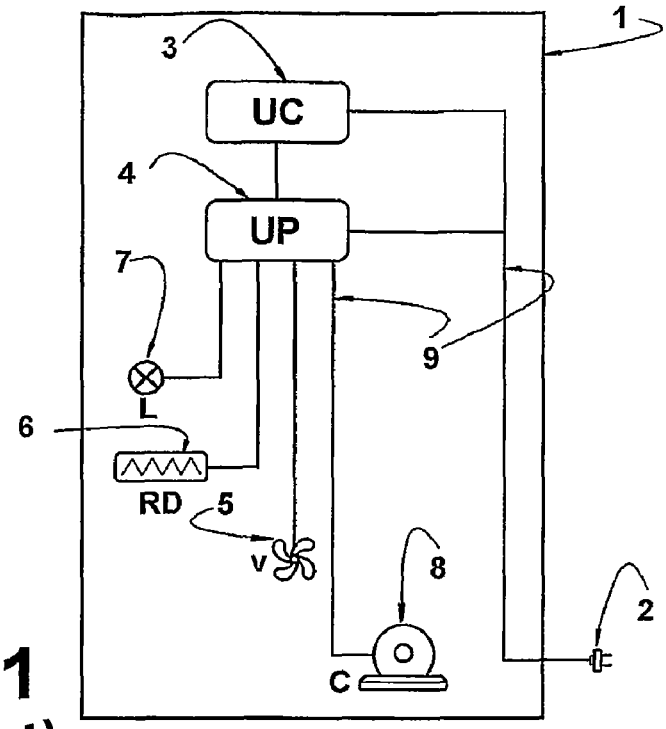
FIG. 1 (Prior Art)
FIG. 1 illustrates, schematically, a refrigerator in which the wiring between the control unit, the power network and the several loads therein is constructed according to the prior art.
Figure 2:
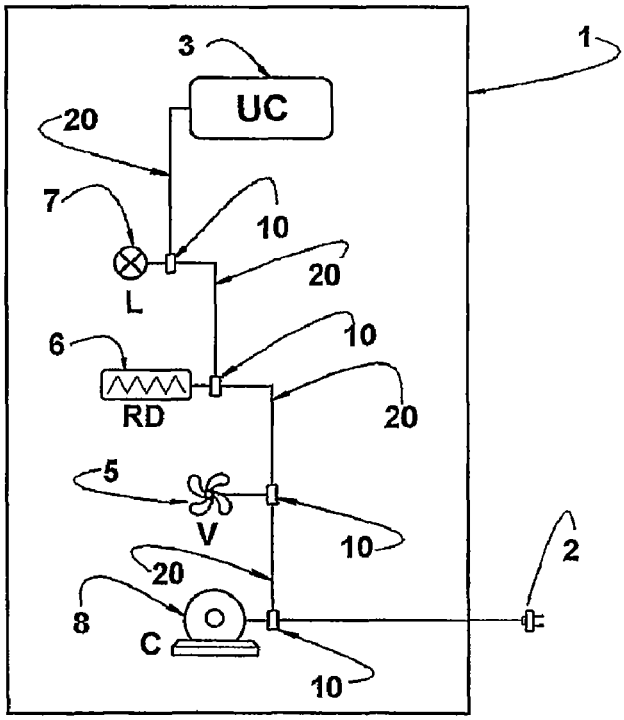
FIG. 2 illustrates, schematically, a refrigerator in which the wiring between the control unit, the power network and the several loads therein is constructed according to the present invention.

According to the description above and to the appended drawings, the system for energizing loads through a control unit of the present invention is applied to a refrigeration appliance, such as a refrigerator 1, in which the loads to be energized, as illustrated in FIGS. 1 and 2 and as mentioned above, comprise a control unit 3 operatively connected to a power network 2, a fan 5, a defrost resistance, an internal lamp 7, and a compressor 8.

However, it should be understood that the inventive concept of said system can be applied to any appliance whose loads are to be energized by command of a central control unit.

The system for energizing loads through a control unit of the present invention comprises, as described below, connecting elements 10, each comprising an electronic circuit having a power switch 11 and a processing unit 12 operatively connected to the power switch 11 so as to lead the latter to opening and closing conditions, de-energizing and energizing a respective adjacent load which is electrically coupled to the connecting element 10. For a refrigerator 1, each load can be represented by one of the following components: fan 5, defrost resistance 6, inner lamp 7, and compressor 8.

According to the present invention, each connecting element 10 can be connected to a cable 20 with at least three wires, two of these wires defining a pair of electrical conductors 21 which are connected to the power network 2 and disposed so as to define an energizing means which is common to the connecting elements 10 and to the control unit 3, and the third wire defining a signal conductor 22, not galvanically isolated from the power network 2, related to the bidirectional serial communication and which is common to the processing units 12 and to the control unit 3, connecting them in such a way as to allow the control unit 3 to instruct, through the processing units 12 and through coded electrical signals, the opening and closing of each respective power switch 11.

The pair of electrical conductors 21 and signal conductor 22 of the cable of the present invention is designed to travel through each of a plurality of loads of the appliance provided with the present energizing system, each of said loads being connected to said conductors through a respective connecting element 10, as shown in FIG. 2. Thus, the several individual cables that usually interconnect the control unit 3 and to the loads such as it occurs in the prior art construction illustrated in FIG. 1 are eliminated, facilitating the mounting steps of said cables in the assembly lines of the appliances provided with the energizing system of the present invention, since besides the existence of a smaller amount of wires distributed throughout said appliance, the connecting elements 10 of the present invention can be provided with an optimized connecting system which can be rapidly coupled to the cable. The command to switch on and off each of the individual loads is carried out by the control unit 3, which can be located in any part of the system.

The serial communication of the present invention is of the non-simultaneous bidirectional type, i.e., of the half-duplex type, master and slave, in which the control unit 3 is the master and each of the connecting elements 10 is a slave and responds only to the commands sent by the master.

According to the present invention, the signal conductor 22 is disposed along the pair of electrical conductors 21, and the cable 20, which defines an assembly of said conductors, passes through all the connecting elements 10 and the control unit 3.

In a construction of the present invention, the connecting element 10 comprises a body carrying inlet terminals 13, each removably coupling a conductor selected from the pair of electrical conductors 21 and the signal conductor 22, one of the inlet terminals 13 associated to an electrical conductor 21 being operatively connected to the power switch 11; and outlet terminals 14, one of them operatively connected to said power switch 11 and the other directly connected to the other inlet terminal 13, said outlet terminals 14 being removably coupled to a respective load.

The inlet terminals 13 can be for example of the type which is adequate for rapid coupling, such as the one of the perforating type.

Each connecting element 10 further comprises provided inside the respective body, besides the power switch 11 and the processing unit 12, a serial interface 15, which is operatively connected to an energization inlet terminal 13, to a communication inlet terminal 13 and to the processing unit 12, in order to enable at least one of the operations of energization, in low voltage, of the connecting element 10 and of bidirectional serial communication between said processing unit 12 and the control unit 3.

Each connecting element 10 further comprises a sensor 16 for detecting the zero voltage of the power network 2 and which is associated to the respective processing unit 12, in order to impart synchronism to the communication between the control unit 3 and each processing unit 12 through the signal conductor 22.

Figure 3:
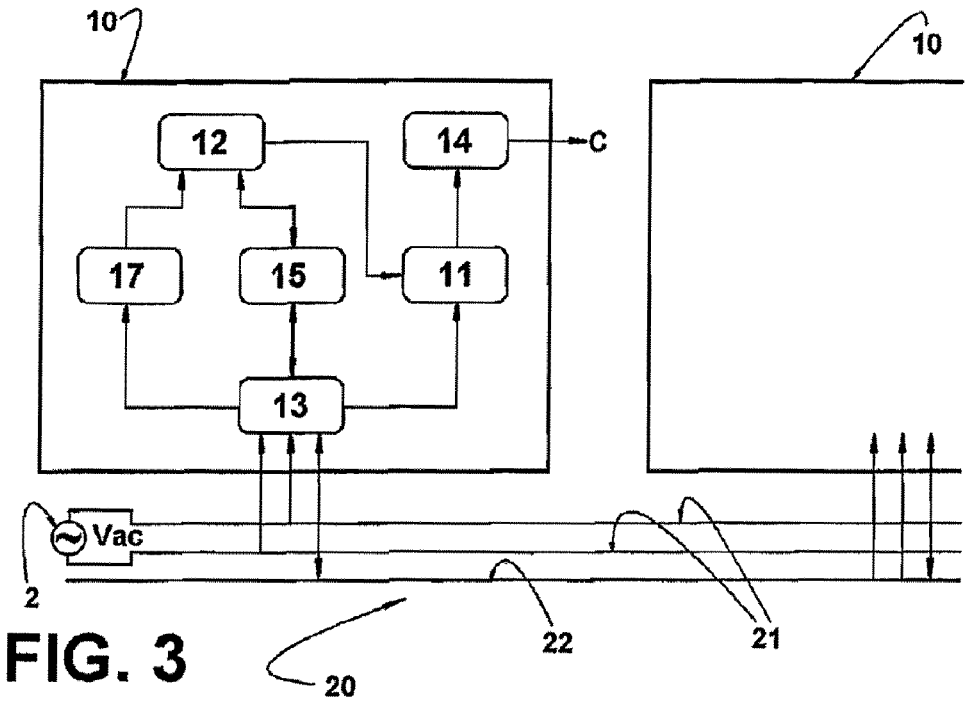
FIG. 3 illustrates, schematically, an embodiment of a system for energizing loads through a control unit provided with an electronic control, constructed according to the present invention.
Figure 5:
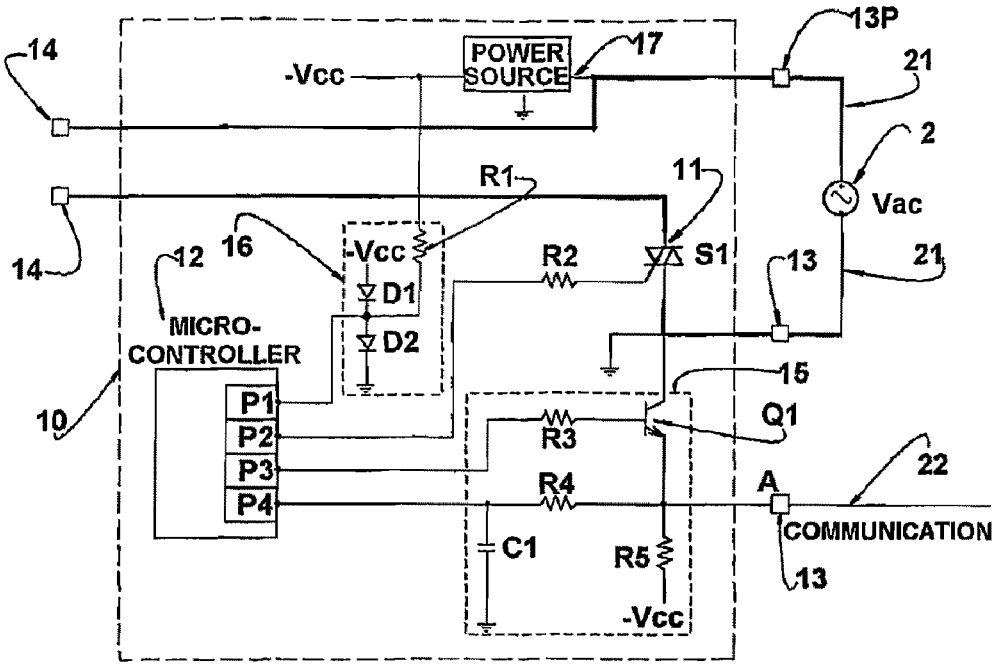
FIG. 5 illustrates, schematically, a first electronic embodiment for the connecting element of the system for energizing loads of the present invention.

In a particular constructive form illustrated in FIGS. 3 and 5, connecting elements 10 of the slave type, i.e., other than those coupled to the control unit 3, further comprise a power source 17, preferably of the capacitive type since the consumption of the circuit is very low, said power source 17 having an inlet electrically connected to one of the energization inlet terminals 13, and an outlet electrically connected to the internal electronic circuit of the connecting element 10. In this embodiment, the energization of each connecting element 10 occurs through the pair of electrical conductors 21, while the signal conductor 22 operates only the bidirectional transmission of communication signals between the control unit 3 and each connecting element 10. For this construction of connecting element 10 of the slave type, it is not necessary for a connecting element 10 of the master type and associated to the control unit 3 to present the outlet of its power source 17 connected to the serial interface 15.

Figure 4:
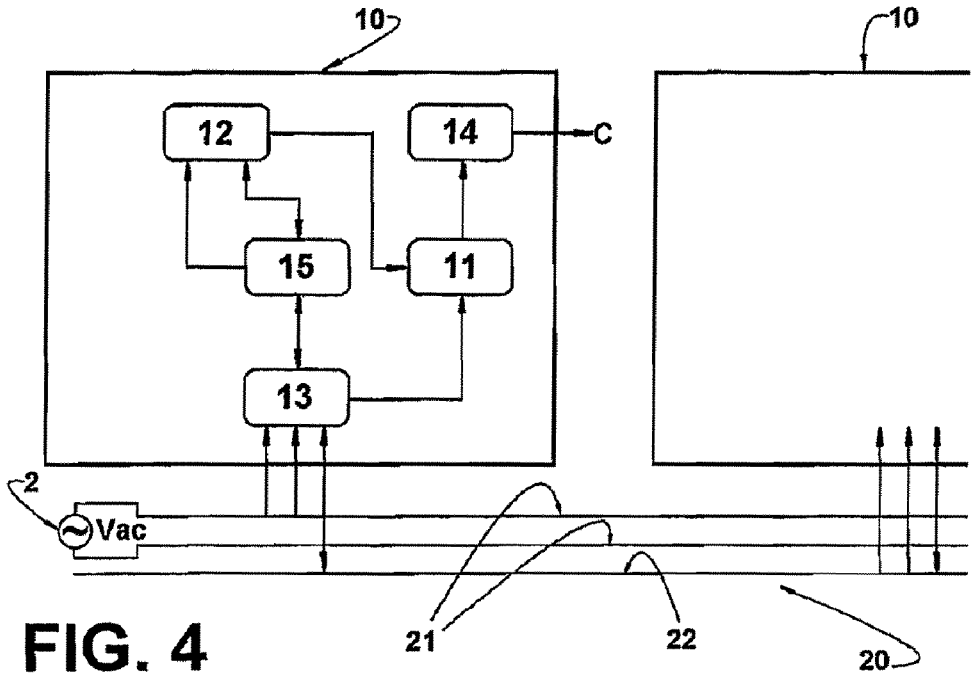
FIG. 4 illustrates, schematically, another embodiment of the system for energizing loads of the present invention.
Figure 6:
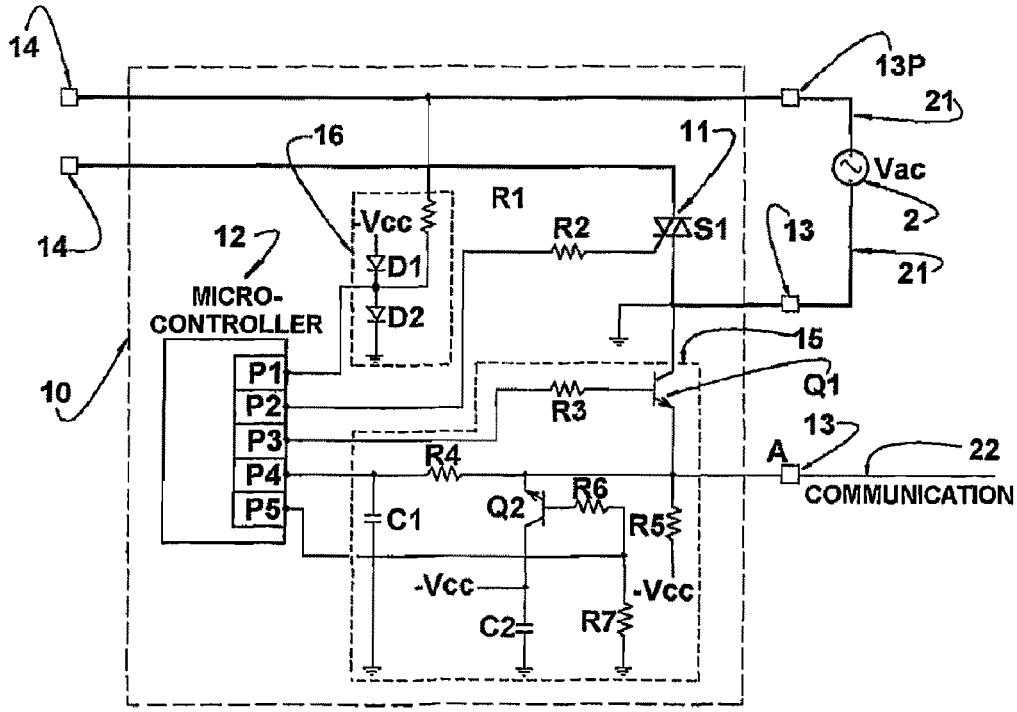
FIG. 6 illustrates, schematically, a second electronic embodiment for the connecting element of the system for energizing loads of the present invention.

In the solution illustrated in FIGS. 4 and 6, the connecting elements 10 of the slave type do not have a power source 17. In this embodiment, the energization of each connecting element 10 is made through the signal conductor 22, which has the function of providing the bidirectional serial communication between the control unit 3 and the processing unit 12 of each connecting element 10, as well as the function of energizing the respective connecting element 10, said functions being selective and alternated in time by instruction of the control unit 3 and carried out when the frequency of the power network passes by zero. In this construction, each connecting element 10 of the slave type comprises a serial interface 15 which enables the operation of bidirectional serial communication and which also enables to extract the supply voltage, in a low voltage, from the communication signal conductor 22 to the internal circuit of the respective connecting element 10.

For this construction of connecting element 10 of the slave type, the connecting element 10 coupled to the control unit 3 comprises a power source 17 having an inlet electrically connected to one of the energization inlet terminals 13 and an outlet electrically connected to the serial interface 15, so that the latter enables the operation of bidirectional serial communication with the connecting elements 10 operatively coupled to the loads and the supply of a low voltage, through the communication signal conductor 22, to the connecting elements 10. With this solution, it is possible to reduce the size and cost of the circuit, making even more viable its use in large scale.

FIG. 5 illustrates a constructive form of a circuit for a connecting element 10 of the type which presents a power source 17. According to this construction, in a condition in which the circuit is not transmitting data, a first transistor Q1 of the serial interface 15 is in an open state and the communication terminal 13, which is indicated by "A" in said FIG. 5, is led to a voltage level of −Vcc, through a fifth resistor R5 of the serial interface 15. Transmission of data occurs when the processing unit 12 of the connecting element 10 instructs one of the conditions of closing and opening of the first transistor Q1, from an outlet of the processing unit 12, indicated by P3, leading the voltage level from point A to 0V or −Vcc, according to the bit transmitted. Reading of data is made by a digital inlet P4 of the processing unit 12, as illustrated in FIG. 5, after said data has passed through a filter formed by a first capacitor C1 and through a fourth resistor R4, preventing the noise from passing to the processing unit 12. The circuit provides low speed asynchronous serial communication, though it allows also the implementation of a synchronous communication, using the voltage of the power network for synchronism, obtained from a first resistor R1 of the sensor 16 and from a first and a second protective diode D1 and D2 of said sensor 16, by applying an input signal P1 of the processing unit 12.

The advantage of the synchronization through the power network 2 is the simplification of the software for the serial communication, since a strict timing control is not required, allowing the use of processing units in the form of microcontrollers of low cost.

Patent EP 0711018A2 discloses a solution in which the synchronization occurs through the power source, but by conventionally using two or more wires for the communication between the loads, said solution requiring however said wires to be galvanically insulated to avoid the passage of current therethrough as a function of installation safety requirements for the application intended by said solution.

FIG. 6 presents an electronic diagram of a constructive variant in which the power source 17 is not illustrated. In this construction, the circuit is supplied by the voltage available from the signal conductor 22, which has the function of supplying current to the inner circuit of the connecting element 10, besides serving as means for the bidirectional serial communication.

Differently from the prior art techniques of simultaneous data multiplexing and supply, the solution of the present invention allows dividing the time in the signal conductor 22 between communication and energization of the circuits.

Data transmission occurs, as already described, upon the selective closing and opening of the first transistor Q1, forcing the voltage of the communication line to 0V or to −Vcc as a function of the bit transmitted and, in this interval, a second transistor Q2 of the connecting element 10 illustrated in FIG. 6 remains open upon application of a voltage −Vcc to an outlet pin P5 of the processing unit 12. In the time interval in which the signal conductor 22 is dedicated to supply energy to the circuits of the connecting elements 10, the processing unit 12 instructs the closing of the second transistor Q2, applying a voltage of 0V to the outlet pin P5 of said processing unit 12, so that a bus capacitor C2 can be loaded, supplying current to the circuit in the subsequent instants when the signal conductor 22 has again the communication function and until the processing unit 12 instructs again the closing of the transistor Q2, interrupting the communication for energizing the respective connecting element 10.

Figure 7:
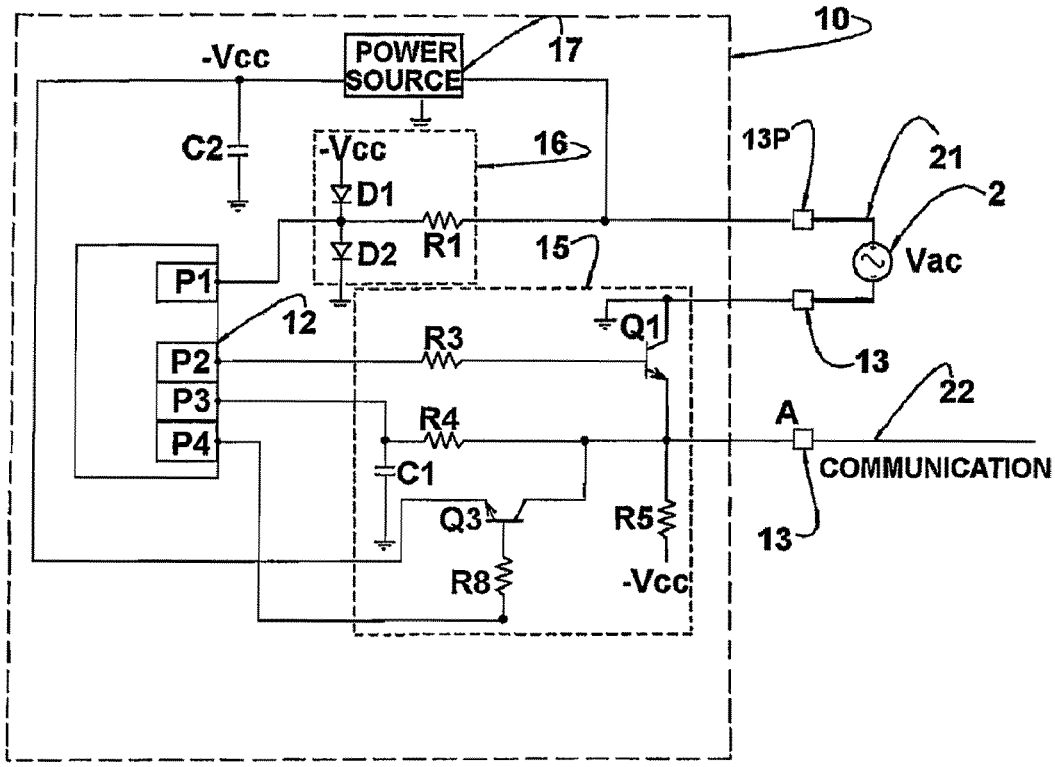
FIG. 7 illustrates, schematically, an electronic embodiment for the connecting element associated with the control unit of the system for energizing loads of the present invention.

FIG. 7 illustrates a constructive form of a circuit suggested for a connecting element of the master type and which is operatively associated with the control unit 3, said connecting element 10 including, besides the components already discussed for the connecting elements 10 of the type associated with the loads, a third transistor Q3, which remains in an open state while an outlet P4 of the processing unit 12 has a −Vcc voltage, allowing the normal data transmission and reception. In the time interval designed to the energization of the circuits, the processing unit 12 instructs the third transistor Q3 to close, applying a voltage of 0V to the outlet pin P4 and allowing the load stored in the second capacitor C2 and generated by the power source 17 to be supplied to the signal conductor 22. Simultaneously, the other connecting elements 10 of the present system associated to loads enable the input of energy to its individual storage capacitors.

The synchronism designed for the communication and energization intervals is effected from the power network 2 so that, for example in positive half-cycles, the signal conductor 22 operates in communication. In this situation, all the connecting elements 10, acting as masters, will command a third transistor Q3 to also remain in an open state. The communication will occur normally, according to the known concepts of master-slave protocols. In the negative half-cycles, no communication will occur, thus all the first communication transistors Q1 will be in the open state and the processing unit 12 of each connecting element 10 will instruct the second transistors Q2 (FIG. 6) to enter in the closed state, allowing current to flow therethrough and, simultaneously, the connecting element 10 acting as a master will instruct the third transistor Q3 to close, allowing the stored generated energy to flow toward the connecting elements 10 that are acting as slaves, supplying the latter. Both the connecting elements 10 acting as slaves and the connecting element 10 acting as a master are conducted to synchronism upon the voltage of the electrical network 2 passing by zero.

Since the half-cycle of the electrical network 2 is dedicated to supply energy to the circuits of the connecting elements 10, the remaining time is of 50 half-cycles available for communication in a network of 50 Hz, i.e., a transfer rate of 50 bits per second or approximately 5 bytes per second, considering the signaling bits. Since the basic commands are to switch on and switch off, it is possible in a single byte to send the address of the controlled connecting element 10 as well as the full command and, if one byte is considered as a response, two commands per second will be possible. The protocol utilized should include the constant supply of a checking character by the connecting element 10 acting as a master and in case it fails, each of the slave or controlled connecting elements 10 must switch off the respective load for the sake of safety, since an unexpected interruption might have occurred in the communication line.

The implementations described above encompass connecting elements 10 of the controlled type and which activate loads. However, it should be understood that the scope of the present invention could be extended to connecting elements 10 which operatively connect the control unit 3 to at least one sensor which provides signals representative of operational conditions of an appliance provided with said energizing system, so that said connecting elements, such as switches, digital and analogical sensors, thermostats, etc., receive input signals.

The invention claimed is:

1. A system for energizing loads through a control unit, said loads being energized from a power network, comprising:

connecting elements, each comprising a power switch and a processing unit operatively connected to the power switch so as to lead the latter to opening and closing conditions, deenergizing and energizing a respective adjacent load that is electrically coupled to the connecting element;

a pair of electrical conductors connected to the power network and which are disposed so as to define an energizing means which is common to the connecting elements and to the control unit;

and a single signal conductor not connected to the control unit and to which all of the processing units are connected, the control unit instructing the respective processing units of each of the connecting elements through coded electrical signals, the opening and closing of each respective power switch, wherein each connecting element further comprises:

a serial interface operatively connected to an energization inlet terminal, to a communication inlet terminal, and to the processing unit, in order to allow at least one of the operations of energization, in low voltage, of the connecting element and of bidirectional serial communication between said processing unit and the control unit;

the serial interface in each of the connecting elements enabling the operation of bidirectional serial communication and extraction of the low voltage for supply to an internal circuit of the respective connecting element;

a signal provided by the power network to the connecting element comprises an alternating current including first and second alternating repeating half-cycles; and the serial interface in each of the connecting elements is operative to extract the low voltage for energizing the connecting unit during each first half cycle of the signal provided by the power network and is operative to provide the bidirectional serial communication during each second halve-cycle of the signal provided by the power network.

2. The system as set forth in claim 1, wherein the signal conductor is disposed along the pair of electrical conductors so that they travel together through all connecting elements and through the control unit.

3. The system as set forth in claim 1, wherein the signal conductor operatively connects the control unit to at least one sensor that provides signals representative of the operational conditions of the appliance provided with said energizing system.

4. The system as set forth in claim 1, wherein each of said connecting elements comprises a body carrying inlet terminals, each connecting element removably coupling a conductor selected from the pair of electrical conductors and from the signal conductor, one of the inlet terminals associated with an electrical conductor being operatively connected to the power switch; and an outlet terminal, being removably coupled to a respective load.

5. The system as set forth in claim 1, wherein the serial interface in each of the connecting elements enables the operation of bidirectional serial communication and extraction of the low voltage from the single communication signal conductor for supply to an internal circuit of the respective connecting element.

6. The system as set forth in claim 1, wherein each connecting element operatively associated with a load comprises a power source having an inlet electrically connected to one of the energization inlet terminals and an outlet electrically connected to the internal circuit of the respective connecting element.

7. A process for energizing loads through a control unit, said loads being energized from a power network, comprising the steps of:

connecting the power network to the control unit by means of a pair of electrical conductors;

connecting, electrically and through a respective power switch, each load to said pair of electrical conductors;

operatively associating, to each power switch, a respective processing unit which is designed to lead said respective power switch to opening and closing conditions;

connecting the control unit to the processing units through only one signal conductor which is common to said units, in order to instruct through said processing units the opening and closing conditions of the respective power switches, wherein, in the connecting the control unit step, the instruction for operating the power switches is synchronized with the passage of the power network voltage, and further providing a signal by the power network to each power switch, the signal comprising an alternating current including first and second alternating repeating half-cycles; operating a serial interface to transmit or receive a low voltage for energizing the processing unit during each first half-cycle of the signal provided by the power network; and operating the serial interface to serially transmit or receive a control signal during each second half-cycle of the signal provided by the power network.

* * * * *